US006551204B1

(12) United States Patent
Di Re

(10) Patent No.: US 6,551,204 B1
(45) Date of Patent: Apr. 22, 2003

(54) BASEBALL BATTING PRACTICE SYSTEM

(76) Inventor: John Di Re, 12117 Yearling St., Cerritos, CA (US) 90703

( * ) Notice: Subject to any disclaimer, the term of this patent is extended or adjusted under 35 U.S.C. 154(b) by 0 days.

(21) Appl. No.: 10/122,949

(22) Filed: Apr. 12, 2002

(51) Int. Cl.[7] ..... A63B 69/00
(52) U.S. Cl. ..... 473/417
(58) Field of Search ..... 473/417, 418–431, 473/393, 396, 138–144, FOR 103, FOR 102; 273/317.6, 332, 390, 391

(56) References Cited

U.S. PATENT DOCUMENTS 4,993,708 A * 2/1991 Prossor et al. ..... 473/417
5,386,988 A * 2/1995 Sung et al. ..... 473/423
5,415,396 A * 5/1995 Huang ..... 473/417
6,296,582 B1 * 10/2001 Minniear ..... 473/428
6,398,671 B1 * 6/2002 Rios ..... 473/417

* cited by examiner

*Primary Examiner*—Paul T. Sewell
*Assistant Examiner*—M. Chambers
(74) *Attorney, Agent, or Firm*—Goldstein & Lavas, P.C.

(57) ABSTRACT

A baseball batting practice system allowing a baseball player to practice their swing without having to retrieve a ball including an inverted T-shaped stand including a lower horizontal base and an upper vertical support. The upper vertical support includes upper and lower segments. The lower segment has an angled lower end. The angled lower end is hingedly coupled with the lower horizontal base. The lower horizontal base includes an angled wedge positioned rearwardly of the angled lower end in an abutting relationship therewith whereby the upper vertical support can only fall forwardly. A ball support cup is secured to and extends upwardly from the upper segment of the upper vertical support. The ball support cup supports a ball thereon. The ball has an eye bolt extending therethrough. The eye bolt has an outer ring positionable within the ball support cup. The outer ring has an interior elastic cord secured thereto. The interior elastic cord has a free end securable interiorly of the upper vertical support.

5 Claims, 5 Drawing Sheets

BASEBALL BATTING PRACTICE SYSTEM

BACKGROUND OF THE INVENTION

The invention relates to a baseball batting practice system allowing a baseball player to practice their swing without having to retrieve a ball.

When ever ball players practice swinging a bat at a ball off of a tee, you would always need an additional person to chase the hit ball or alternately, need a large net or the like to hit the ball into. Additionally, most tee devices used to hold baseballs for hitting, will usually break apart when contacted by accident. This presents an additional limitation of the known batting tees. Thus, the present invention is a significant improvement over the batting tees known in the art.

Several references show various baseball throwing machines. U.S. Pat. No. 5,415,396 to Huang discloses a baseball batter practice machine. U.S. Pat. No. 4,993,708 to Prosser et al. Discloses a batting tee having a tee ball stand allowing for simulation of actual hitting conditions. U.S. Pat. No. 2,976,041 to White discloses a baseball practice stand used to improve practice standards. U.S. Pat. No. 4,445,685 to Cardieri discloses a batting tee.

While these units may be suitable for the particular purpose employed, or for general use, they would not be as suitable for the purposes of the present invention as disclosed hereafter.

SUMMARY OF THE INVENTION

It is an object of the invention to produce a baseball batting practice system allowing a baseball player to practice their swing without having to retrieve a ball including an inverted T-shaped stand including a lower horizontal base and an upper vertical support. The upper vertical support includes upper and lower segments. The upper segment is telescopically received within the lower segments. The upper segment is adjustable with respect to the lower segment to predetermined height intervals. The lower segment has an angled lower end. The angled lower end is hingedly coupled with the lower horizontal base. The lower horizontal base includes an angled wedge positioned rearwardly of the angled lower end in an abutting relationship therewith whereby the upper vertical support can only fall forwardly. The lower horizontal base has an elastic cord secured to a rear end thereof. The elastic cord has a free end securable to the lower horizontal base. A ball support cup is secured to and extends upwardly from the upper segment of the upper vertical support. The ball support cup supports a ball thereon. The ball has an eye bolt extending therethrough. The eye bolt has an outer ring positionable within the ball support cup. The outer ring has an elastic cord secured thereto. The elastic cord has a free end securable near the bottom of the upper vertical support.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
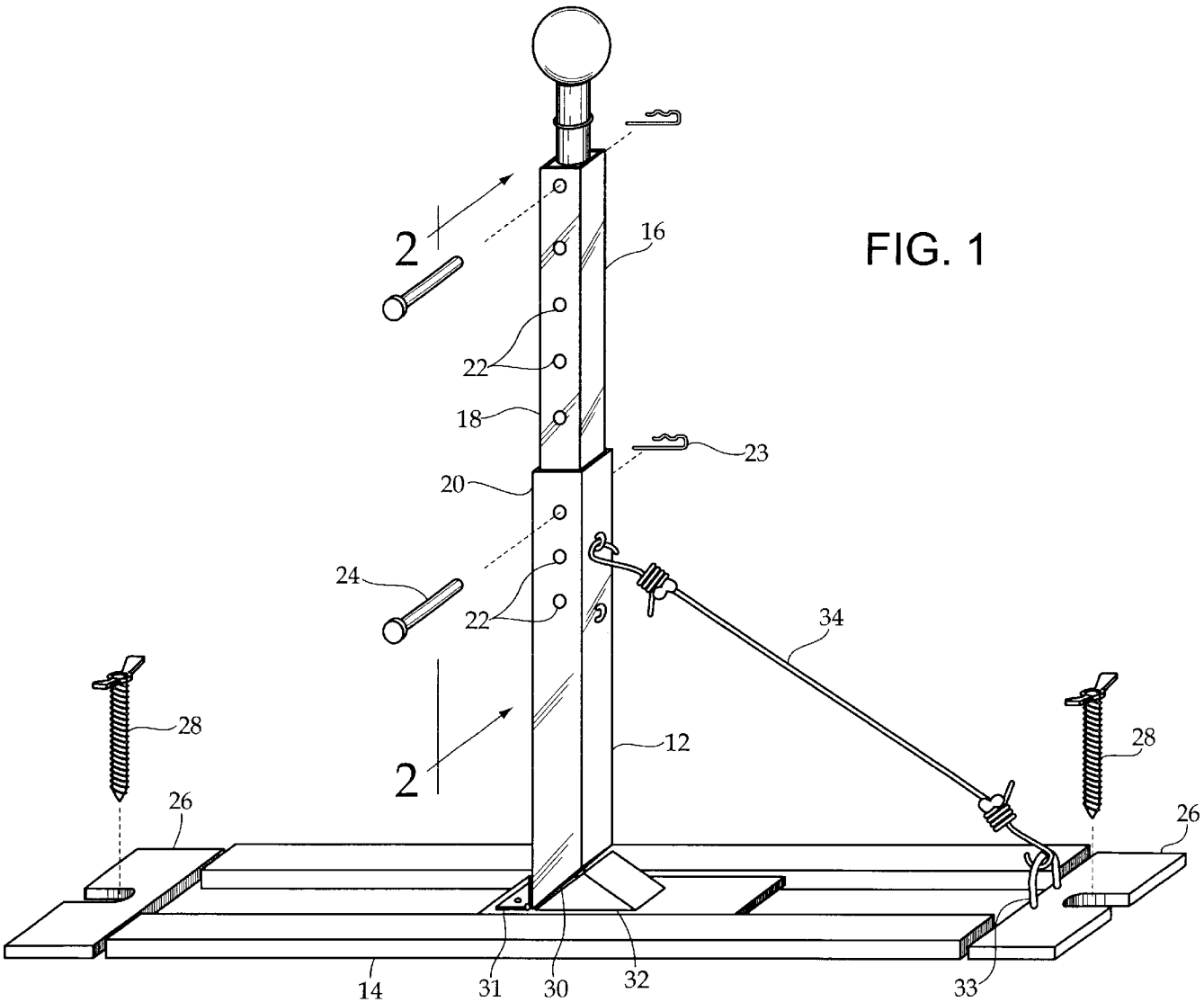
FIG. 1 is a perspective view of the present invention.
Figure 2:
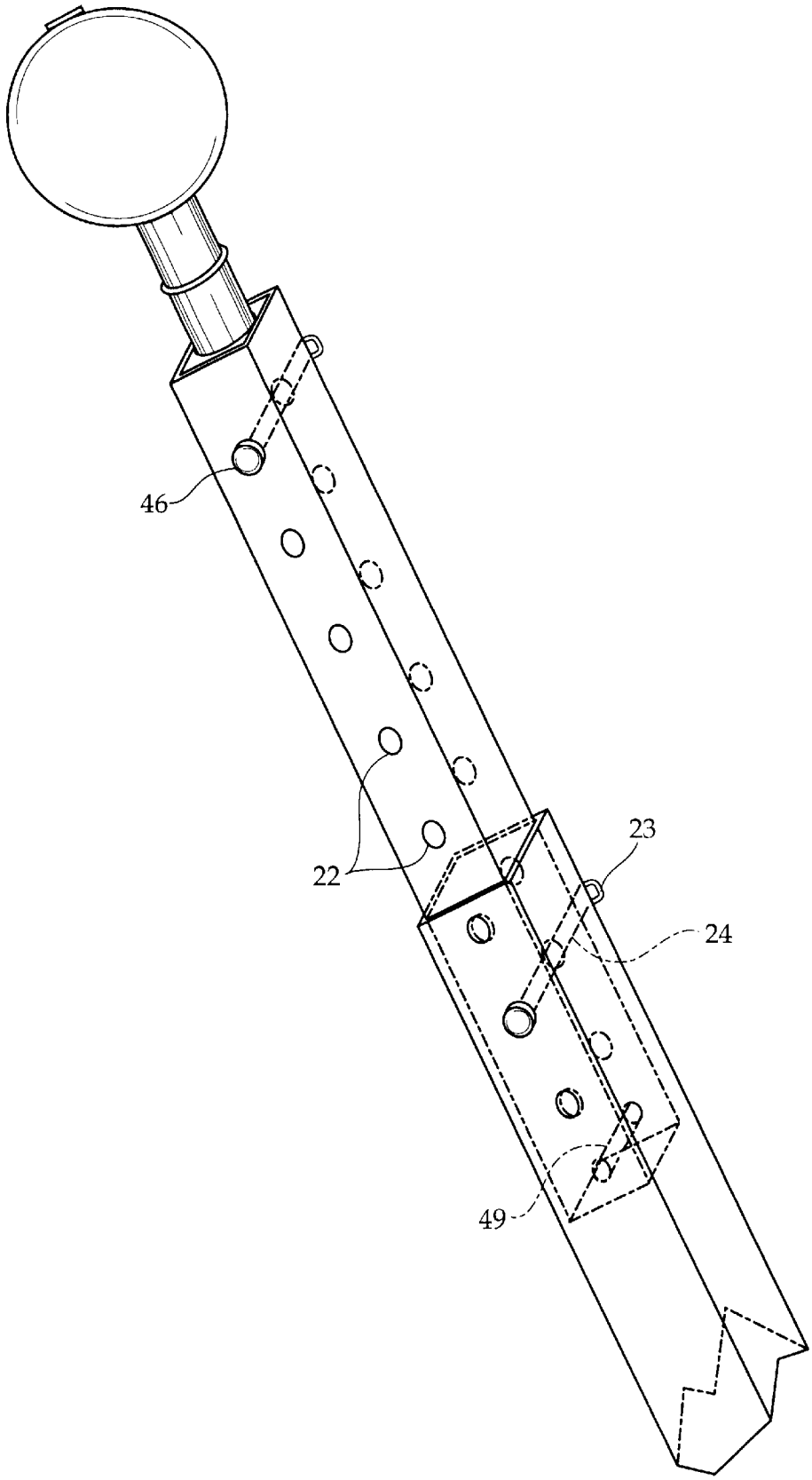
FIG. 2 is a perspective view of the upper vertical support of the present invention.

It will be noted in the various figures that the device relates to a baseball batting practice system allowing a baseball player to practice their swing without having to retrieve a ball. In its broadest context, the device consists of an inverted T-shaped stand and a ball support cup. Such components are individually configured and correlated with respect to each other so as to attain the desired objective.

The inverted T-shaped stand 12 includes a lower horizontal base 14 and an upper vertical support 16. The upper vertical support 16 includes upper and lower segments 18,20. The upper segment 18 is telescopically received within the lower segment 20. The upper segment 18 is adjustable with respect to the lower segment 20 to predetermined height intervals. The upper and lower segments 18,20 each have corresponding apertures 22 therethrough that can be aligned to receive a removable cylindrical height adjustment pin 24 to fix the height of the upper vertical support 16 to suit a particular user, and a cotter pin 23 to secure the removable cylindrical pin 24 in place. The lower horizontal base 14 is provided with additional end portions 26 that are capable of receiving anchoring screws 28 to secure the stand 12 to a recipient ground surface. The additional end portions 26 may be either permanently attached to the remainder of the lower horizontal base 14 as in FIG. 5, or the additional end portions 26 may be constructed as "angle irons" wherein the remainder of the lower horizontal base 14 is sandwiched between said additional end portions 26 once they are suitably mounted to the ground surface using the anchoring screws 28.

The lower segment 20 has an angled lower end 30. The angled lower end 30 is hingedly coupled with the lower horizontal base 14 with a hinge 31. The lower horizontal base 14 includes an angled wedge 32 positioned beneath and rearwardly of the angled lower end 30 in an abutting relationship therewith whereby the upper vertical support 16 can only fall forwardly. The angled wedge 32 are angled lower end 32 are complementary, such that the lower segment 20 typically extends perpendicular to the base 14, except when it is caused to lean forward. Note FIG. 5. The lower horizontal base 14 has an external elastic cord 34 secured to a rear end thereof, opposite from the hinge 31. In particular, preferably, a U-hook 33 is provided at one of the additional end portions 26 to provide direct anchoring to the ground surface. The external elastic cord 34 has a free end securable to the lower segment 20 through an eyelet or the like. The external elastic cord 34 biases the angled lower end 32 against the angled wedge 32 so that the upper vertical support 16 typically remains vertical. However, once the upper vertical support 16 falls forwardly resulting from being struck by a swung baseball bat, the external elastic cord 34 will tension and return the upper vertical support 16 to an upright orientation perpendicular to the lower horizontal base 14.

Figure 3:
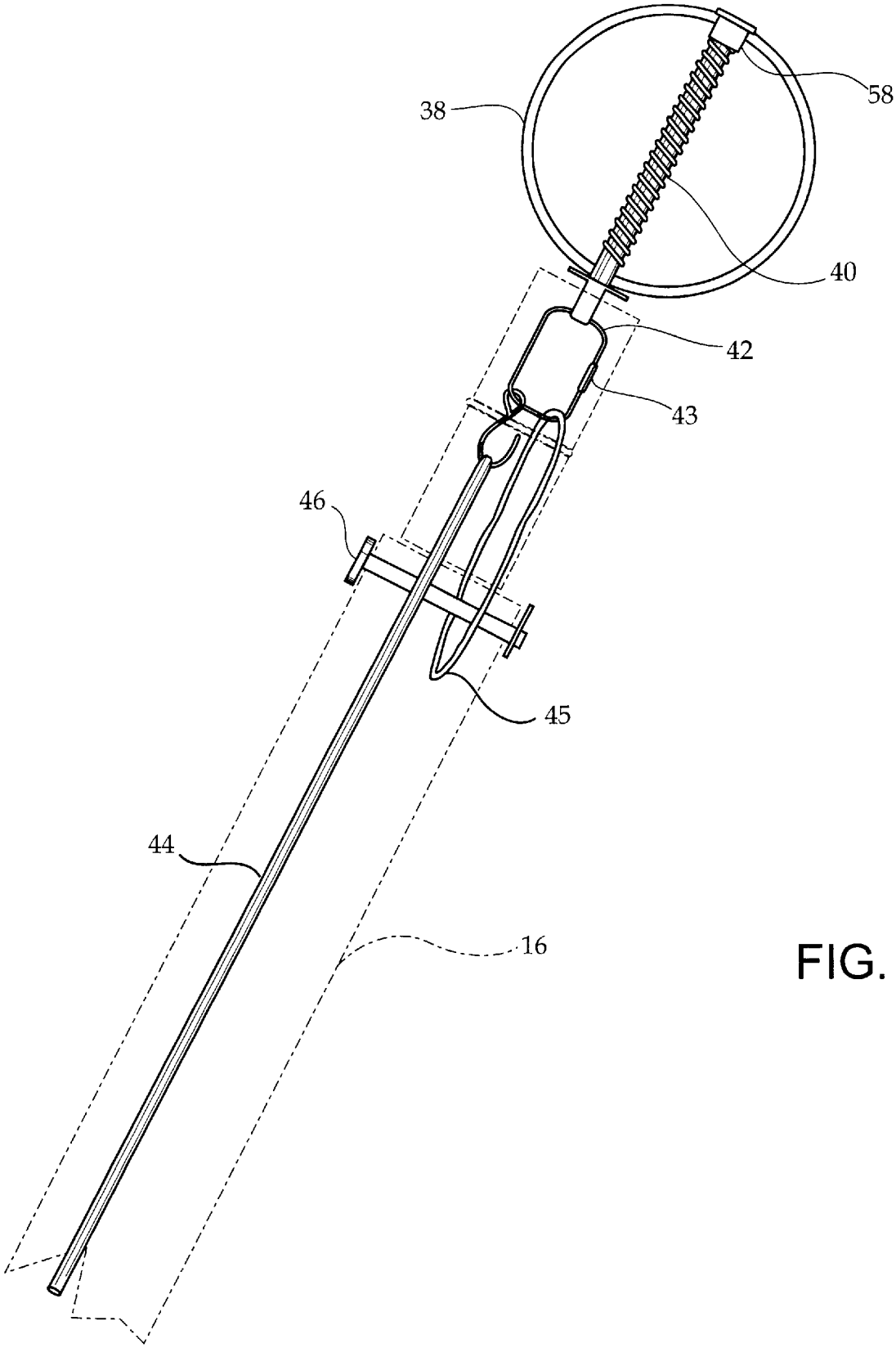
FIG. 3 is a perspective interior view of the upper vertical support of the present invention.
Figure 4:
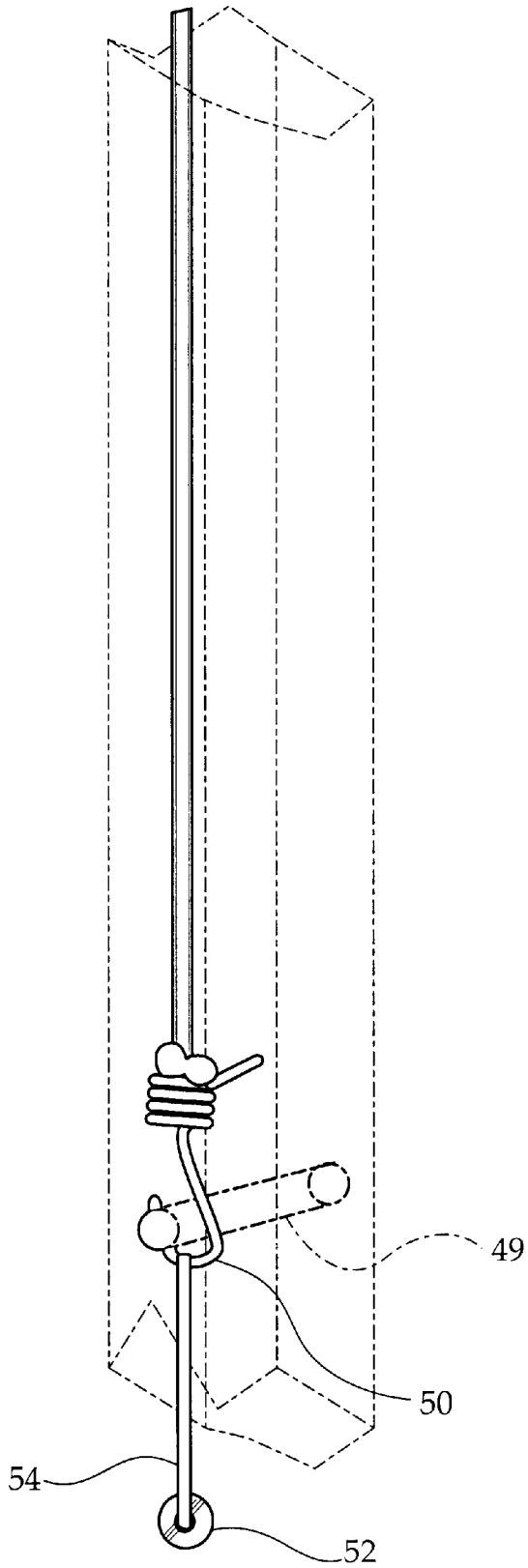
FIG. 4 is a perspective interior view of the upper vertical support of the present invention.

The ball support cup 36 is secured to and extends upwardly from the upper segment 18 of the upper vertical support 16. The ball support cup 36 is tubular, made of a resilient material, and supports a ball 38 thereon. Referring to FIG. 3, the ball 38 is secured to the upper vertical support 16. In this regard, the ball 38 has an eye bolt 40 extending therethrough, secured with a tubular nut 58, the tubular nut is flat on one side so that it does not protrude significantly from the curved outer surface of the ball 38. An outer ring 42 extends through the eye bolt 40 and is positionable within the ball support cup 36. The outer ring 42 may have a gate 43 to allow items to be selectively secured or removed from the outer ring 42. The outer ring 42 has an interior elastic cord 44 and a nylon safety loop 45 secured thereto. As illustrated in FIG. 3, the nylon safety loop 45 is looped around a nylon safety cord pin 46, which is fastened to the upper vertical support 16 near its top. The nylon safety loop 45 has significant slack, such that it normally is not tensioned between the outer ring 42 and the nylon safety loop pin 46, but acts as a safety back-up, to prevent the ball 38 from flying off if the interior elastic cord 44 were to fail.

The interior elastic cord 44 has a free end securable interiorly of the upper vertical support 16 with an interior elastic cord pin 49, welded near the bottom of the upper segment 18. In particular, the free end of the interior elastic cord 44 has an S-hook 50 which selectively attaches to the elastic cord pin 49. An additional cord 54 is to the S-hook 50 and to a washer 52 disposed within the upper support 16. The additional cord 54 pulls down the interior elastic cord 44 so that the S-hook can be hooked onto the elastic cord pin 49.

Figure 5:
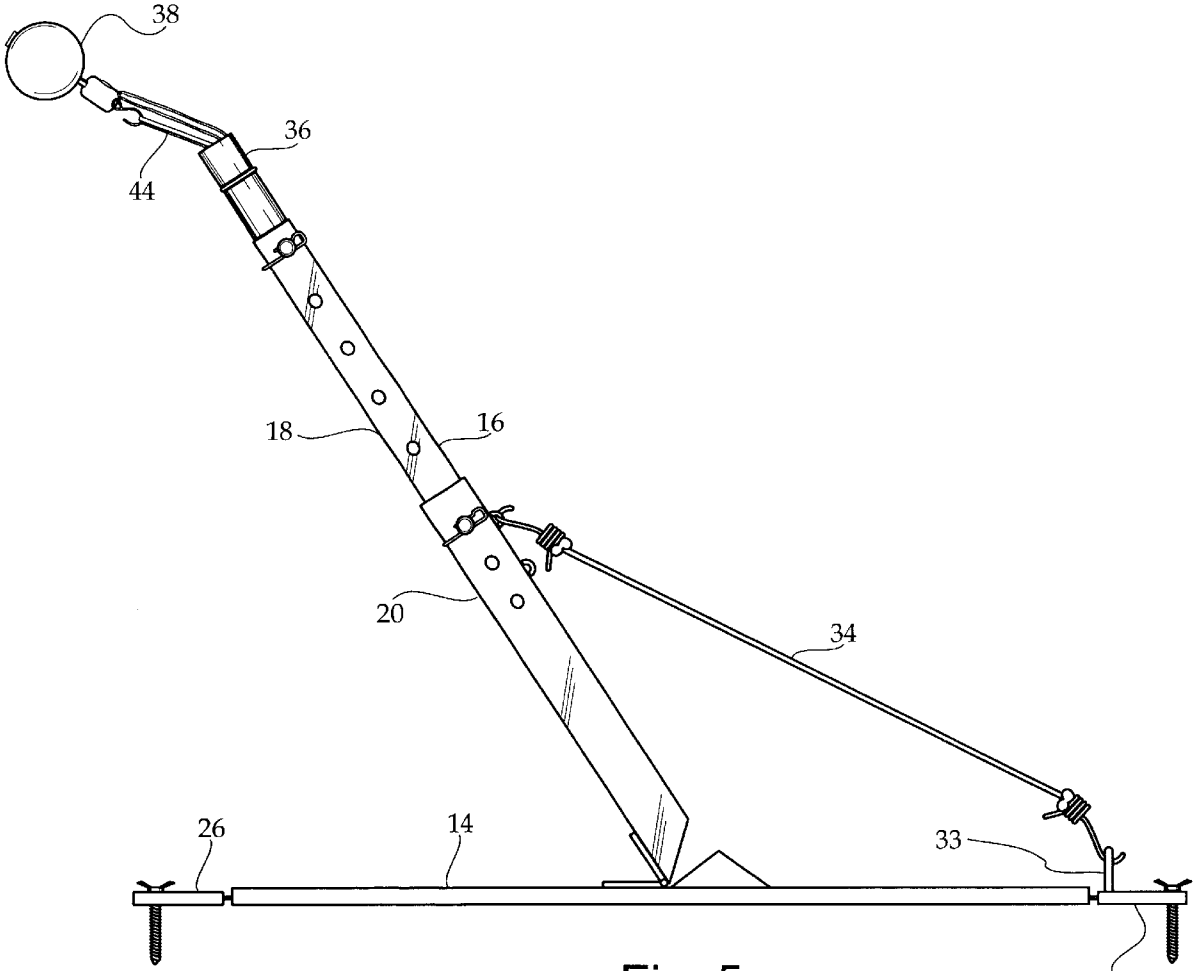
FIG. 5 is a side view of the present invention illustrated in use.

FIG. 5 illustrates the device in use, wherein the ball 38 has been struck, pulling the ball 38 somewhat upward and away from the ball support cup 36. The interior elastic cord 44 stretches but keeps the ball 38 tethered to the upper vertical support 16. The momentum of the ball 38 pulls the vertical support 16 forward at the hinge 31, which stretches and tensions the external elastic cord 34. The elastic cord 34 will retract to release its tension, restoring the upper vertical support 16 to its typical vertical position.

What is claimed is:

1. A baseball batting practice system allowing a baseball player to practice their swing without having to retrieve a ball, comprising, in combination:

an inverted T-shaped stand including a lower horizontal base and an upper vertical support hingeably attached to the lower base with a hinge, the upper vertical support including upper and lower segments, the upper segment being telescopically received within the lower segments, the upper segment being adjustable with respect to the lower segment to predetermined height intervals, the lower segment having an angled lower end, the angled lower end being hingedly coupled with the lower horizontal base, the lower horizontal base including an angled wedge positioned rearwardly of hingethe angled lower end in an abutting relationship therewith whereby the upper vertical support normally extends vertically and can only fall forwardly;

an external elastic cord secured between the vertical support and lower horizontal base, the lower horizontal base biasing the vertical support to the vertical position, and for pulling the vertical support back to the vertical position after it has fallen forward; and a ball support cup secured to and extending upwardly from the upper segment of the upper vertical support, the ball support cup is tubular, supporting a ball thereon, the ball having an eye bolt extending therethrough, an outer ring extends through the eye bolt within the ball support cup, an interior elastic cord is secured to the outer ring and has a free end securable interiorly of the upper vertical support.

2. A baseball batting practice system allowing a baseball player to practice their swing without having to retrieve a ball, comprising, in combination:

an inverted T-shaped stand including a lower horizontal base and an upper vertical support, the upper vertical support including upper and lower segments, the lower segment having an angled lower end, the angled lower end being hingedly coupled with the lower horizontal base with a hinge, the lower horizontal base including an angled wedge positioned rearwardly of the hinge in an abutting relationship with the angled lower end of the lower segment, whereby the upper vertical support normally extends vertically, but can only fall forwardly; and a ball support cup secured to and extending upwardly from the upper segment of the upper vertical support, the ball support cup supporting a ball thereon, the ball having an eye bolt extending therethrough, an outer ring is attached through the eye bolt within the ball support cup, an interior elastic cord is secured to the outer ring and has a free end securable interiorly of the upper vertical support.

3. The baseball batting practice system as set forth in claim 2, wherein the upper segment is telescopically received within the lower segments, the upper segment being adjustable with respect to the lower segment to predetermined height intervals.

4. The baseball batting practice system as set forth in claim 2, wherein an external elastic cord is secured to a the lower segment of the vertical support and to the lower horizontal base, for biasing the vertical support to the vertical position and restoring the vertical support to the vertical position after it has fallen forward.

5. The baseball batting practice system as recited in claim 4, further comprising a safety loop and a safety loop pin, the safety loop pin is securable within the upper segment of the vertical support, the safety loop is attached around the outer ring and the safety loop pin untensioned, so that the safety loop acts as a back-up safety device to prevent the ball from flying away if the interior elastic cord were to fail.

* * * * *